US007226280B1

(12) United States Patent
Yokoi et al.

(10) Patent No.: US 7,226,280 B1
(45) Date of Patent: Jun. 5, 2007

(54) ROOTS VACUUM PUMP

(75) Inventors: Yasuna Yokoi, Ama-gun (JP); Yoshinobu Ito, Mie-gun (JP)

(73) Assignee: Anlet Co., Ltd., Aichi (JP)

( * ) Notice: Subject to any disclaimer, the term of this patent is extended or adjusted under 35 U.S.C. 154(b) by 0 days.

(21) Appl. No.: 11/546,221

(22) Filed: Oct. 10, 2006

(30) Foreign Application Priority Data

Jun. 1, 2006 (JP) ..... 2006-153097

(51) Int. Cl.
*F03C 2/00* (2006.01)
*F04C 2/00* (2006.01)

(52) U.S. Cl. ..... 418/206.4; 418/15; 418/180; 418/206.1

(58) Field of Classification Search ..... 418/9, 418/15, 78, 180, 206.1–206.5
See application file for complete search history.

(56) References Cited

U.S. PATENT DOCUMENTS

| | | | | | |
|---|---|---|---|---|---|
| 2,489,887 | A | * | 11/1949 | Houghton | 418/180 |
| 3,667,874 | A | * | 6/1972 | Weatherston et al. | 418/206.4 |
| 4,789,314 | A | * | 12/1988 | Higuchi et al. | 418/15 |
| 5,944,501 | A | * | 8/1999 | Yokoi | 418/206.1 |
| 6,176,693 | B1 | * | 1/2001 | Conti | 418/180 |
| 6,203,297 | B1 | * | 3/2001 | Patel | 418/15 |

FOREIGN PATENT DOCUMENTS

| | | | | | |
|---|---|---|---|---|---|
| JP | 59115489 | A | * | 7/1984 | 418/9 |
| JP | 01056919 | A | * | 3/1989 | |
| JP | 03124986 | A | * | 5/1991 | 418/206.5 |
| JP | 2616823 | | | 6/1997 | |
| JP | 2884067 | | | 4/1999 | |
| JP | 2001082370 | A | * | 3/2001 | |
| JP | 2001227487 | A | * | 8/2001 | |

* cited by examiner

*Primary Examiner*—Theresa Trieu
(74) *Attorney, Agent, or Firm*—Koda & Androlia

(57) ABSTRACT

In a Roots vacuum pump, an inlet port is located at a position n spaced by a positive displacement angle of 120° in one direction from a center of each rotational axis relative to an imaginary line m connecting rotor axes. An outlet port is located at a position o opposite to the inlet port relative to the line. An air feed port is formed at a position t on a casing wall obtained by returning by 90° from the position o to the inlet port side so that two closed spaces are defined by adjacent rotor lobes and a casing inner wall at both port sides immediately after air suction respectively. The casing has discharge grooves in an area of the inner wall so as to communicate with the outlet port. The area ranges from the position o to a position u obtained by returning by 45° from the position o to the inlet port side. The discharge grooves have a total volume ranging from 2% to 5% of a volume of one of the closed spaces.

1 Claim, 4 Drawing Sheets

P
1
2
3
4
6
8
10
S

ROOTS VACUUM PUMP

CROSS-REFERENCE TO RELATED APPLICATIONS

This application is based upon and claims the benefit of priority from the prior Japanese Patent Application No. 2006-153097, filed on Jun. 1, 2006, the entire contents of which are incorporated herein by reference.

BACKGROUND OF THE INVENTION

1. Field of the Invention

The present invention relates to a three-lobed spar rotor or helical rotor type Roots vacuum pump used as a vacuum source for dust collectors.

2. Description of the Related Art

In conventional positive displacement Roots vacuum pumps, a casing at an outlet port side has a temperature ranging from about 120° C. to about 150° C. by heat of compression when pressure difference of −45 kPa or above is caused between an inlet port side and the outlet port side during operation of the pumps. Consequently, domestic and foreign manufacturers have taken necessary steps since about 1960 in order to prevent the temperature increase. In one of such steps, the casing is provided with a feed port through which outside air or cooling air is introduced into the casing so that the aforesaid temperature of the casing is reduced to 120° C. or below. Furthermore, measures have also been taken against noise produced during operation of the pump. The assignee of the present application has offered effective suggestions in Japanese Patent Nos. 2616823, 2884067 and the like.

It is known that a closed space is defined by two adjacent rotor lobes and an inner peripheral wall surface in general three-lobed rotor Roots vacuum pumps. It is also known that the aforesaid closed space necessitates a positive displacement angle of 120°. When the positive displacement angle is less than 120°, an inlet port and an outlet port of the pump communicate with each other. Consequently, the pump cannot operate.

Some Roots vacuum pumps have a structure that the aforesaid feed port for outside air or cooling air is provided in a part of the area of the positive displacement angle. These pumps result in reductions in volumetric efficiency and mechanical efficiency and production of loud noise of 90 dB or above. Accordingly, use of these Roots vacuum pumps necessitates installation for noise reduction which reduces noise depending upon environment in which the pumps are installed. Such installation increases the costs, resulting in diseconomy. Furthermore, a high-temperature gas caused by compression leaks little by little through a minute gap inevitably defined by the inner peripheral wall and rotor lobes to the suction side. This results in a reduction in the mechanical efficiency of the vacuum pump and deterioration in the temperature characteristic.

SUMMARY OF THE INVENTION

Therefore, an object of the present invention is to provide a Roots vacuum pump which can improve the volumetric efficiency and energy saving effect and reduce noise produced during operation thereof and decrease the temperature of the whole pump.

The present invention provides a Roots vacuum pump comprising a casing having an inlet port and an outlet port both formed therein and a pair of three-lobed rotors provided in the casing to be rotatable so that the inlet and outlet ports are prevented from communicating with each other, whereupon air is sucked through the inlet port and the sucked air is discharged through the outlet port. In the pump, the inlet port is located at a position n spaced by a positive displacement angle of 120° in one direction from a center of each rotational axis relative to an imaginary line m connecting the centers of the rotational axes of the respective rotors. The outlet port is located at a position o spaced by a positive displacement angle of 120° in a direction opposite the direction of the inlet port from the center of each rotational axis relative to the imaginary line m. Outside air or cooling air feed port is provided at a position t on a peripheral wall of the casing obtained by returning by 90° from the position o to the inlet port side so that two closed spaces are defined by adjacent lobes of the rotors and an inner peripheral wall surface of the casing at the inlet and outlet port sides immediately after suction of air respectively. The casing has a plurality of discharge grooves which are formed in a region of the inner peripheral wall surface so as to communicate with the outlet port. The region ranges from the position o to a position u obtained by returning by 45° from the position o to the inlet port side. The discharge grooves have a total volume ranging from 2% to 5% of a volume of one of the closed spaces.

According to the foregoing Roots vacuum pump, the volumetric efficiency and energy saving can be improved and noise produced during operation of the pump can be reduced. Furthermore, the temperature of the whole pump can be decreased.

BRIEF DESCRIPTION OF THE DRAWINGS

Other objects, features and advantages of the present invention will become clear upon reviewing the following description of the embodiment with reference to the accompanying drawings, in which.

DETAILED DESCRIPTION OF THE INVENTION

Figure 1:
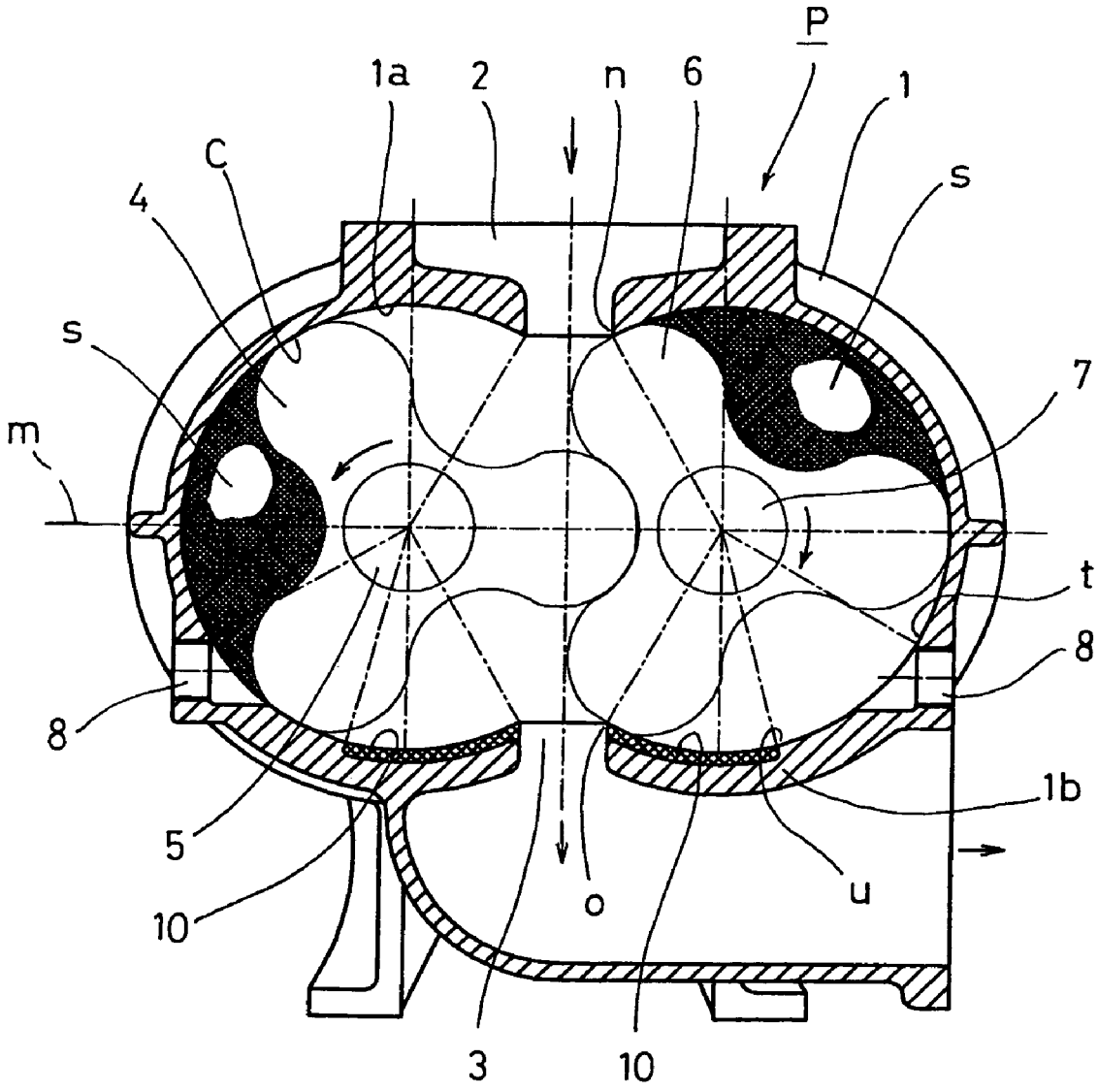
FIG. 1 is a longitudinally sectional side view of a three-lobed Roots vacuum pump of one embodiment in accordance with the present invention.

One embodiment of the present invention will be described with reference to the accompanying drawings. Referring to FIG. 1, a here-lobed Roots vacuum pump P includes a casing 1 formed with an inlet port 2 and an outlet port 3. A pair of three-lobed rotors 4 and 6 are provided in the casing 1 so as to be rotatable in opposite directions respectively. The rotors 4 and 6 are rotated so that the inlet and outlet ports 2 and 3 are prevented from communicating with each other, so that air is sucked through the inlet port 2 and the suck air is discharged through the outlet port 3. A small gap C having a predetermined dimension is defined between an inner wall surface 1*a* of the casing 1 and apex of each rotor lobe as well known in the art.

Figure 2:
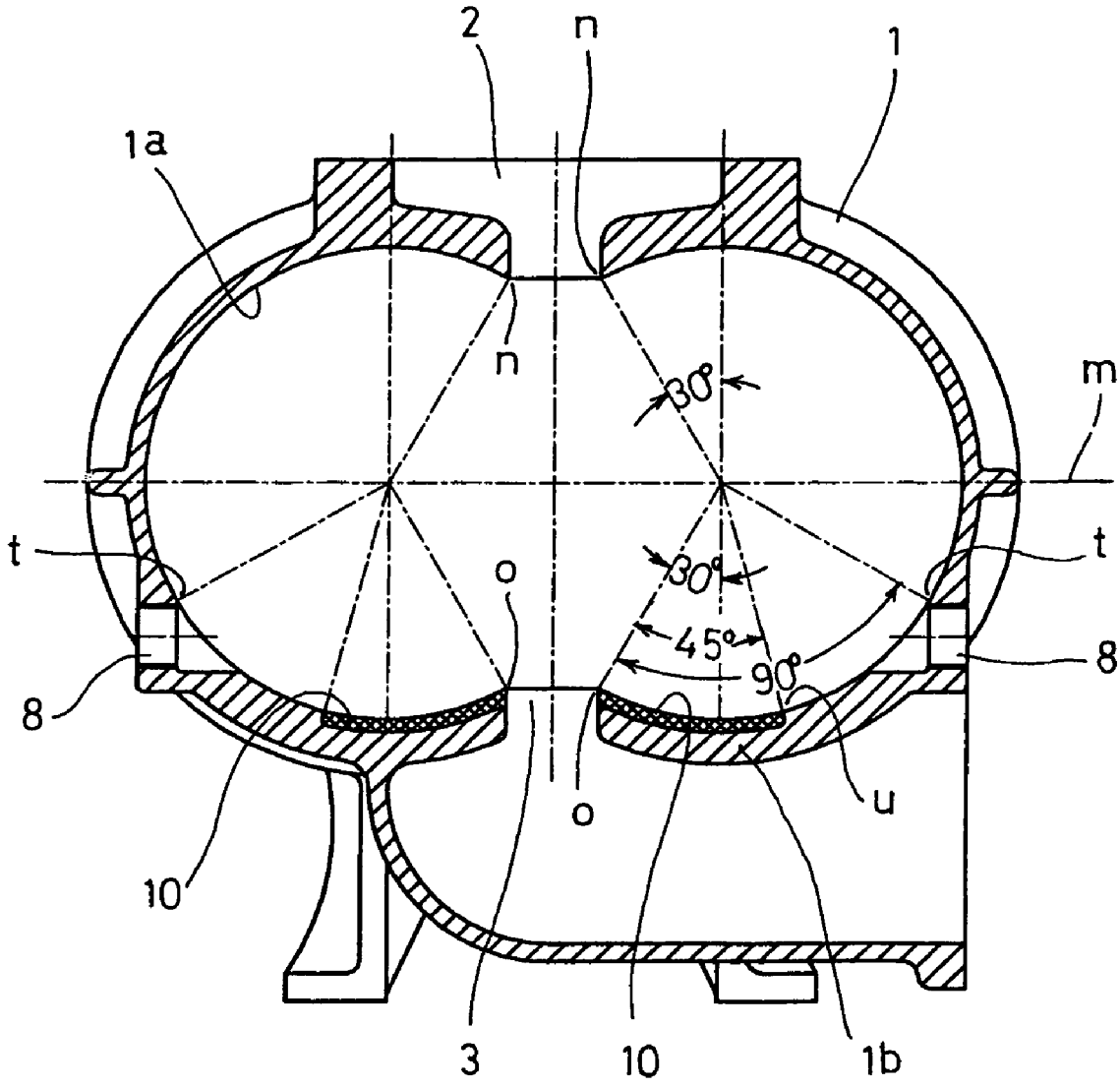
FIG. 2 is a longitudinally sectional side view of a casing.

As shown in FIGS. 1 and 2, the inlet port 2 is located at a position n spaced by a positive displacement angle of 120° or above in one direction from centers of the rotating shafts 5 and 7 relative to an imaginary line m connecting the centers of the rotating shafts of the rotors 4 and 6 respectively. The outlet port 3 is also located at a position o spaced by a positive displacement angle of 120° or above in a direction opposite the direction of the inlet port 2 from the centers of the rotating shafts 5 and 7 relative to the imaginary line m. Two outside air or cooling air feed ports 8 are provided at positions t on a peripheral wall 1*b* of the casing 1 obtained by returning by 90° from the position o to the inlet port 2 side so that two closed spaces s are defined by adjacent lobes of the rotors 4 and 6 and an inner peripheral wall surface 1*a* of the casing 1 at the inlet and outlet port 2 and 3 sides immediately after suction of air respectively.

The casing 1 has a plurality of discharge grooves 10 which are formed in a region of the inner peripheral wall surface thereof so as to communicate with the outlet port 3. The region ranges from the position o to a position u obtained by returning by 45° from the position o to the inlet port 2 side. The discharge grooves 10 have a total volume desirably ranging from 2% to 5% of a volume of one of the closed spaces s.

Figure 3C:
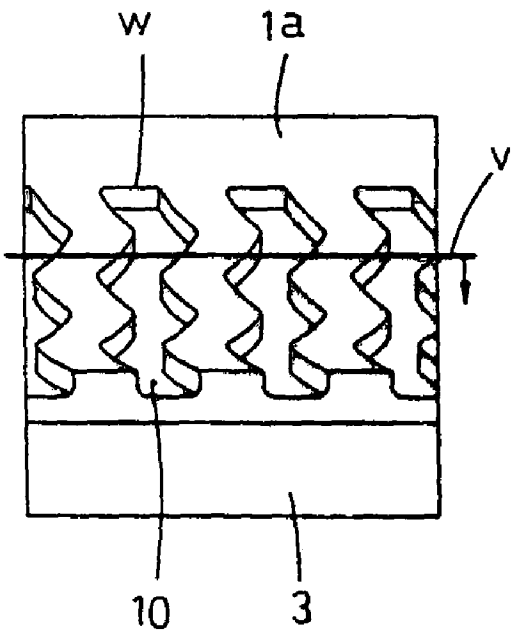
FIGS. 3A to 3C are developed views of linear, helical and zigzag meandering type discharge grooves respectively.
Figure 3B:
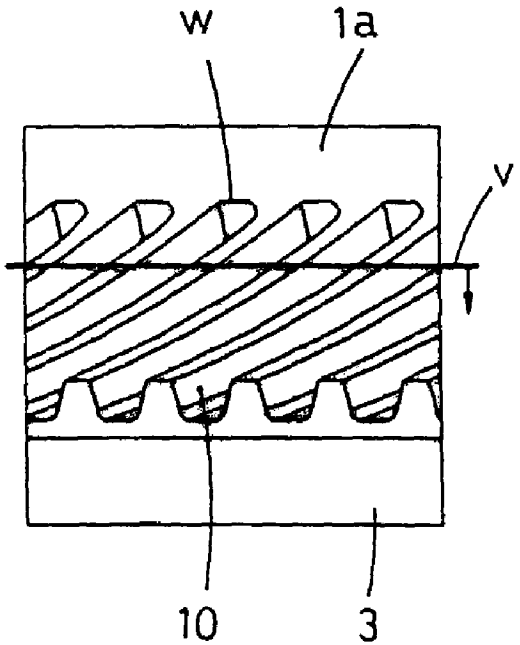
Figure 3A:
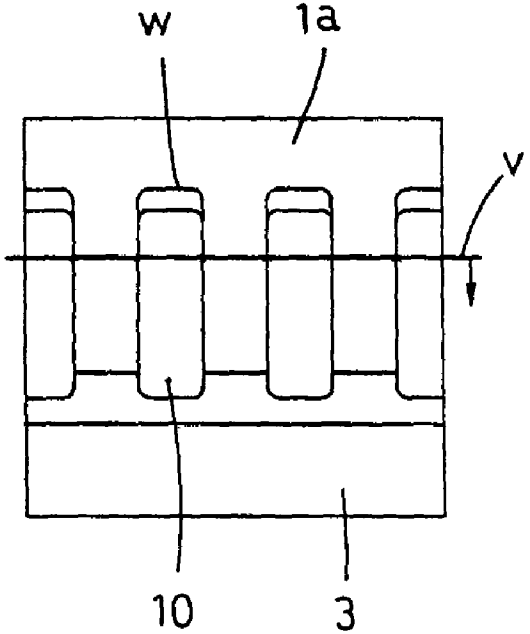
Figures 4A, 4B, 4C, 4D, 4E, 4F, 4G:
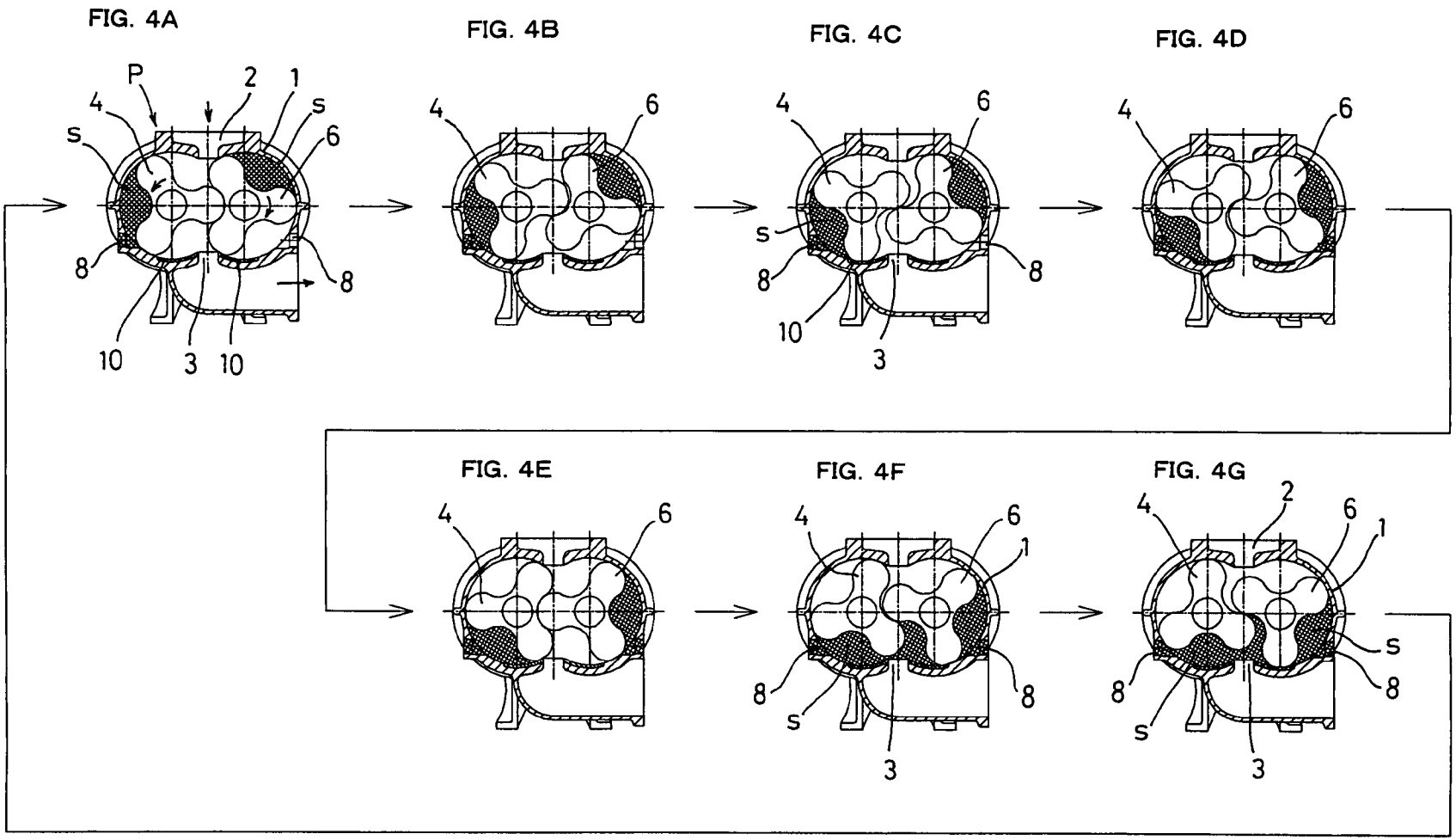
FIGS. 4A to 4G illustrate movement of fluid in a closed space defined by adjacent lobes of rotors and an inner peripheral wall surface of the casing.

Each discharge groove 10 may be formed into any one of linear, helical and zigzag meandering shapes as shown in FIGS. 3A to 3C respectively. In the figures, reference symbol v designates an imaginary line contact between distal ends of the rotors 4 and 6 and the inner peripheral wall surface 1*a* of the casing 1.

FIGS. 4A to 4G illustrate movement of fluid in the closed spaces s defined by adjacent lobes of rotors 4 and 6 and an inner peripheral wall surface 1*a* of the casing 1 respectively. In the figures, shaded areas show outside air or cooling air flowing through the feed ports 8 into the closed spaces s moving with rotation of the rotors 5 and 7.

In this Roots vacuum pump P, a gas in each closed space s moves to the outlet port 3 side with rotation of the rotors 4 and 6. When the aforesaid line contact v exceeds point w on the inner wall surface 1*a* of the casing 1, the gas is discharged while moving in each space s and gradually mixing with outside air at the outlet port 3 side. This prevents rapid pressure mixing of the gas with the outside air at the outlet port side, suppressing explosion of compressed gas and noise.

The operation of the Roots vacuum pump P will now be described. In the Roots vacuum pump P, each closed spaces is defined by adjacent lobes of the rotors 4 and 6 and the inner peripheral wall surface 1*a* of the casing 1. The total positive displacement angle of each closed space s is set at 240° which is twice the positive displacement of 120°. Thus, a seal portion between the top of each rotor lobe and the inner peripheral wall surface 1*a* of the casing 1 has a relatively longer movement distance. Consequently, an amount of internal leak can be reduced.

Furthermore, two closed spaces s are defined at the outlet port 3 side and at the inlet port 2 side respectively immediately after air is sucked through the inlet port 2. Accordingly, since the pressure distribution due to an internal leak from the outlet port 3 side has two stages, the pressure difference is reduced between the outlet port 3 and the closed space s at the outlet port 3 side. The pressure difference is also reduced between the closed space s at the outlet port 3 side and the closed space s at the inlet port 2 side. The pressure difference is further reduced between the closed space s at the inlet port 2 side and the inlet port 2. Consequently, an amount of internal leak can be reduced.

Furthermore, since the peripheral wall 1*b* of the casing 1 has at the positions t the feed ports 8 through which outside air or cooling air is fed into the casing, the temperature of the pump body including the casing 1, rotors 4 and 6, and rotating shafts and 7 can be prevented from rising. Additionally, since the casing 1 is formed with the discharge grooves 10 at the outlet port 3 side, the sucked air can be prevented from being confined within the casing 1, whereupon energy saving and noise reduction can be achieved.

An experiment was conducted about the performance of the Roots vacuum pump of the embodiment and the like. The following describes the results of the experiment. The used Roots vacuum pump had a bore of 80 mm and a drive motor of 7.5 kW was used. The rotor was rotated at a rotational speed of 1350 rpm. Vacuum pressure ranged from −40 kPa to −70 kPa. Experimental results show that an amount of air is increased by 20% to 40% in the Roots vacuum pump of the embodiment as compared to conventional pumps and required power is reduced by about 5% to 10%. Consequently, an improvement in the mechanical efficiency can be confirmed.

Furthermore, the experimental results show that surface temperatures of various portions of the vacuum pump are decreased by 10° to 20° as compared with the conventional pumps and noise is reduced by 5 dB to 10 dB as compared with the conventional pumps.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A Roots vacuum pump comprising a casing having an inlet port and an outlet port both formed therein and a pair of three-lobed rotors provided in the casing to be rotatable so that the inlet and outlet ports are prevented from communicating with each other, whereupon air is sucked through the inlet port and the sucked air is discharged through the outlet port, wherein the inlet port is located at a position n spaced by a positive displacement angle of 120° in one direction from a center of each rotational axis relative to an imaginary line m connecting the centers of the rotational axes of the respective rotors, and the outlet port is located at a position o spaced by a positive displacement angle of 120° in a direction opposite the direction of the inlet port from the center of each rotational axis relative to the imaginary line m, wherein outside air or cooling air feed port is provided at a position t on a peripheral wall of the casing obtained by returning by 90° from the position o to the inlet port side so that two closed spaces are defined by adjacent lobes of the rotors and an inner peripheral wall surface of the casing at the inlet and outlet port sides immediately after suction of air respectively, wherein the casing has a plurality of discharge grooves which are formed in a region of the inner peripheral wall surface so as to communicate with the outlet port, said region ranging from the position o to a position u obtained by returning by 45° from the position o to the inlet port side, the discharge grooves having a total volume ranging from 2% to 5% of a volume of one of the closed spaces.

* * * * *